US008479935B2

(12) United States Patent
Straughan

(10) Patent No.: US 8,479,935 B2
(45) Date of Patent: Jul. 9, 2013

(54) CHILD RESISTANT CLOSURE

(75) Inventor: Simon Straughan, Newcastle upon Tyne (GB)

(73) Assignee: Cope Allman Jaycare Limited, Portsmouth (GB)

( * ) Notice: Subject to any disclaimer, the term of this patent is extended or adjusted under 35 U.S.C. 154(b) by 395 days.

(21) Appl. No.: 12/682,520

(22) PCT Filed: Oct. 15, 2008

(86) PCT No.: PCT/GB2008/003496

§ 371 (c)(1),
(2), (4) Date: Jun. 15, 2010

(87) PCT Pub. No.: WO2009/050457

PCT Pub. Date: Apr. 23, 2009

(65) Prior Publication Data

US 2010/0243598 A1 Sep. 30, 2010

(30) Foreign Application Priority Data

Oct. 16, 2007 (GB) ..... 0720163.5

(51) Int. Cl.
*B65D 41/17* (2006.01)
*B65D 55/02* (2006.01)

(52) U.S. Cl.
USPC ..... 215/216; 215/221; 215/225; 215/321; 215/330

(58) Field of Classification Search
USPC ..... 215/216, 221, 225, 321, 330, 901
See application file for complete search history.

(56) References Cited

U.S. PATENT DOCUMENTS

| | | | | | |
|---|---|---|---|---|---|
| 3,744,655 | A | * | 7/1973 | Nixdorff, Jr. | 215/216 |
| 4,036,385 | A | * | 7/1977 | Morris | 215/209 |
| 4,061,239 | A | * | 12/1977 | Tasseron | 215/221 |
| 4,520,921 | A | * | 6/1985 | Vissing | 206/1.5 |
| 4,948,002 | A | * | 8/1990 | Thornock et al. | 215/221 |
| 5,038,454 | A | * | 8/1991 | Thornock et al. | 29/451 |
| 5,040,694 | A | | 8/1991 | Gambello | |
| 5,230,433 | A | * | 7/1993 | Hamilton et al. | 215/221 |
| 5,383,564 | A | * | 1/1995 | Hamilton et al. | 215/221 |

(Continued)

FOREIGN PATENT DOCUMENTS

EP 0606261 B1 2/1996

OTHER PUBLICATIONS

International Search Report and Written Opinion of the International Searching Authority, mailed Feb. 9, 2009, for corresponding International Application No. PCT/GB2008/003496.

*Primary Examiner* — Mickey Yu
*Assistant Examiner* — Niki Eloshway
(74) *Attorney, Agent, or Firm* — Klarquist Sparkman, LLP

(57) ABSTRACT

A child resistant closure for a container (1) comprises a collar (3) fixable to a container (1) and a rotatable cap (4). The cap (4) is provided with a first engaging member (10) and the collar (3) is provided with a corresponding second engaging member (21). Adjacent said engaging member the collar (3) is provided with a resiliently deformable integral push tab (24), characterised in that the first and second engaging members (10, 21) are adapted to engage by rotation of the cap (4). It is an advantage of one embodiment that the cap of the closure does not require an internal screw thread. The cap may therefore be simpler and less expensive to manufacture. In addition, the two components, e.g., the cap and the collar, can be assembled prior to application onto the container.

14 Claims, 3 Drawing Sheets

U.S. PATENT DOCUMENTS 5,819,967 A * 10/1998 Lo ..... 215/206
5,865,330 A * 2/1999 Buono ..... 215/216
6,036,036 A * 3/2000 Bilani et al. ..... 215/216
6,076,689 A 6/2000 Vassallo
2004/0182814 A1 * 9/2004 Suffa ..... 215/216
2010/0051572 A1 * 3/2010 Beecroft et al. ..... 215/216

* cited by examiner

CHILD RESISTANT CLOSURE

FIELD OF THE INVENTION

The present invention relates to a novel closure means and a container comprising said closure means.

The container may hold a variety of materials, but is especially suitable for materials such as medicines, eg pharmaceutical preparations, which may be in solid, tablet, granular, powdered, semi-solid paste or liquid form.

BACKGROUND

Child resistant packaging is known for preventing children from opening potentially dangerous materials such as medications. A variety of child resistant containers are known. One particular example comprises a squeezable cap which consists of an inner closure member, usually provided with an internal screw thread adapted to engage with a correspondingly threaded neck of the container, enabling the cap to be secured in a closed position. The cap is also provided with a squeezable outer skirt provided with a pair of locking lugs, eg adjacent the lower end of the skirt. The cap locking lugs are adapted to pass inwardly of the container locking lugs and to be compressed radially inwardly when the cap is rotated to a cap closing position.

The locking lugs engage with corresponding lugs positioned on the container preventing the closure from being unscrewed. Squeezing of the outer skirt of the closure enables the locking lugs to be clear of the container lugs allowing the cap to be unscrewed from the container.

However, such a childproof cap design suffers from a number of disadvantages, including that removal of the cap may be difficult for elderly individuals who may, for example, suffer from rheumatoid arthritis and may consequently suffer from impairment to their manual dexterity in their hands/fingers. Furthermore, the construction of such a cap requires the cap, ie including the outer skirt, to be of a larger diameter than would otherwise be necessary, so as to provide sufficient diametrical space to enable the cap to be squeezed inwardly. In addition, one other disadvantage of the conventional "squeeze and turn" packs is that because they are now common place, children are becoming increasingly aware of how to open them. Therefore, there is an increasing requirement for a pack or closure design that will not be "instinctive" for children to open, but will allow adults to gain access once the adults have read the instructions.

Attempts have been made to improve on such designs. Thus, for example, European Patent No. 0 606 261 describes a child resistant package for storing and dispensing potentially dangerous materials, such as medicament tablets or the like. The package comprises a bottle provided with a collar, secured over the upper portion of the bottle, and a closure which may be secured to the bottle by means of corresponding screw threads. The collar includes a pair of resiliently deformable spring-like push tabs which include vertical extensions capable of engaging interlocking teeth on the innermost surface of the closure skirt. To remove the closure the push tabs are manually depressed prior to applying unscrewing torque to the closure.

However, whilst the package described in EP'261 is suitably child resistant, the design still requires a secondary closure mechanism, eg corresponding screw threads and requires the collar to be assembled onto the bottle prior to the closure being screwed on.

Therefore, there remains a need for a relatively easy to assemble child resistant container which may still be readily opened by those lacking normal manual dexterity.

STATEMENT OF INVENTION

Therefore, according to a first aspect of the invention there is provided a child resistant closure for a container, said closure comprising a collar fixable to a container and a rotatable cap, wherein said cap is provided with a first engaging member and the collar is provided with a corresponding second engaging member and, adjacent said engaging member the collar is provided with a resiliently deformable integral push tab, characterised in that the first and second engaging members are adapted to engage by rotation of the cap.

It is an advantage of the present invention that, unlike conventionally known child proof closures, the cap of the closure does not require an internal screw thread. This is advantageous in that, inter alia, the cap may be simpler and therefore less expensive to manufacture. In addition, the two components, ie the cap and the collar, can be assembled prior to application onto the container (ie a relatively simple operation only requiring a downward force). Whereas with prior art assemblies, such as that described in European Patent No. 0 606 261, the lower component must be assembled onto the container prior to the closure being screwed on.

Although a variety of engaging members may be used, in a preferred embodiment of the invention the first engaging member comprises a resilient clip. Such a clip may comprise a tongue with a leading edge and a trailing edge. The trailing edge is provided with a raised portion, eg a shoulder. When the first engaging member comprises a clip as hereinbefore described, the second engaging member will comprise a clip stop in the form of a raised member provided with a slot, through which the clip can pass. Thus, the tongue will protrude through the slot until the shoulder abuts the walls surrounding the slot, bringing the cap to a halt.

The clip will prevent removal of the closure from collar of a container by rotating the closure in the reverse direction unless the resiliently deformable push tab on the collar is first depressed to disengage the clip from the clip stop. The clip also prevents removal of the cap by simply pulling the cap in a longitudinal direction.

In a preferred embodiment of the invention this clip stop is located on the collar and the clip is located on the cap. However, it will be understood by a person skilled in the art that the closure member of the present invention could operate by placing the clip on the collar and the clip slot on the cap.

In a further aspect of the invention the upper surface of the collar is inclined and the lower surface of the cap is also inclined, in a manner corresponding to the incline of the collar. The use of an inclined surface is advantageous in that a user, when rotating the cap towards a closed position, will simultaneously urge the cap downwards. The inclined surfaces of the cap and/or the collar may be provided with a buffer in the form of a substantially vertical end wall position on the inclined surface of the collar.

The collar is preferably a substantially circumferential collar and the engaging members, eg the clip and the clip slot are therefore preferentially circumferentially facing.

In a preferred embodiment, the closure is provided with a plurality of first and second engaging members. The optimum number is preferably two, that is, a pair of first engaging members and a corresponding pair of second engaging members. When a pair of engaging members are present, eg a pair of clips and a pair of corresponding clip stops, they are preferably positioned on opposing faces of the cap/collar. It is advantageous to have a pair of clips, eg one on each side of the cap, since the cap may be optimised to by limiting the amount of depression required on the push pads It will be appreciated that the closure of the invention is for use in conjunction with a container, and preferably a container comprising medicament. Therefore, according to a further aspect of the invention we provide a container comprising a child resistant closure as hereinbefore described. The closure is particularly designed for use with a container which comprises an aerosol delivery device.

Furthermore, the collar may optionally include a moulding that is adapted to limit the movement of the push tabs, thereby enabling an additional element of control of the flexibility of the push tabs and/or the one or more resilient tongues. Such a moulding is advantageous in that, inter alia, it allows the closure of the invention to be "fine tuned" in order to optimise its functionality.

Embodiments of the invention will now be described, by way of example only, with reference to the following drawings.

Figure 3:
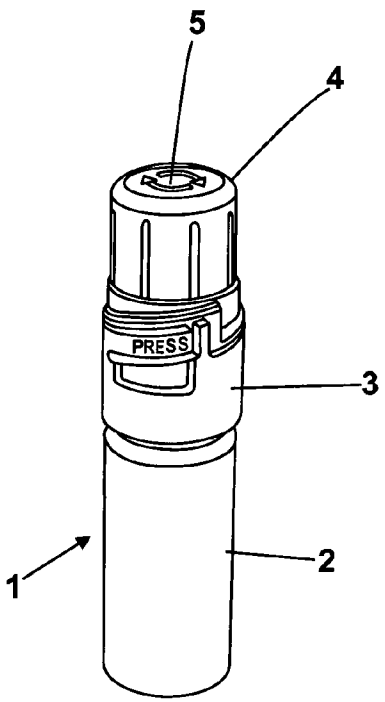
FIG. 3 is a perspective view of the container and closure of FIGS. 1 and 2, in the closed position.
Figure 2:
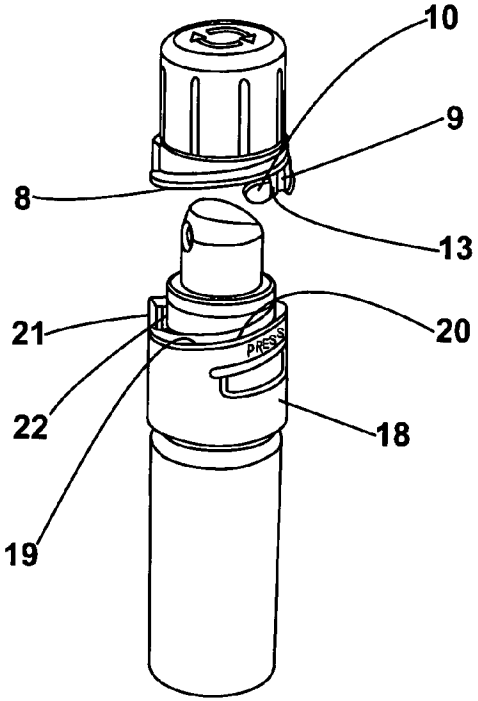
FIG. 2 is a perspective view of the disassembled container and closure of FIG. 1 showing the clip stop.
Figure 1:
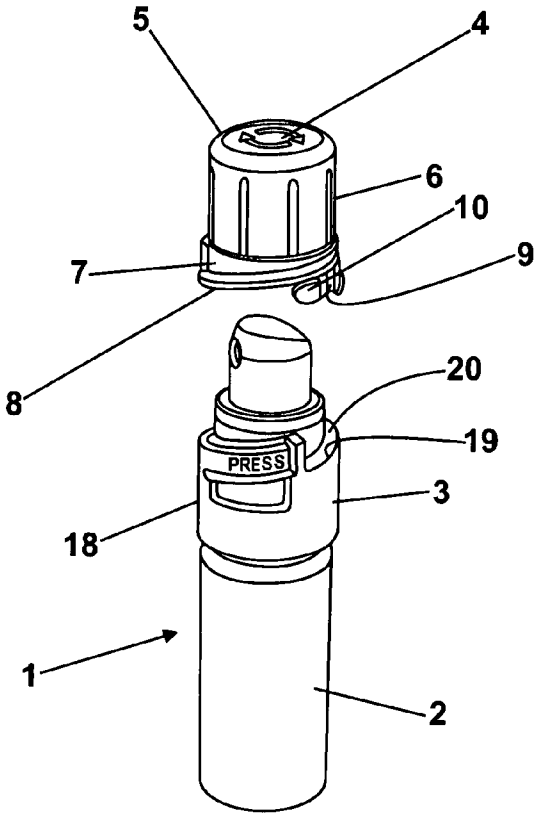
FIG. 1 is a perspective view of the disassembled container and closure in the accordance with the present invention, in the open position.
Figure 7:
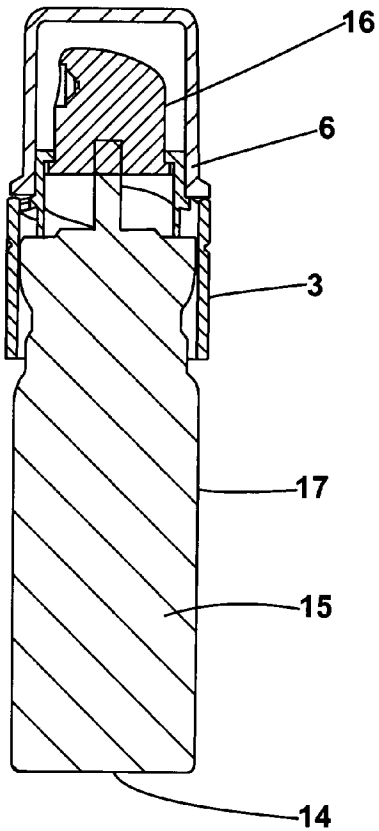
FIG. 7 is a cross-sectional view along the line D-D of FIG. 6.
Figure 6:
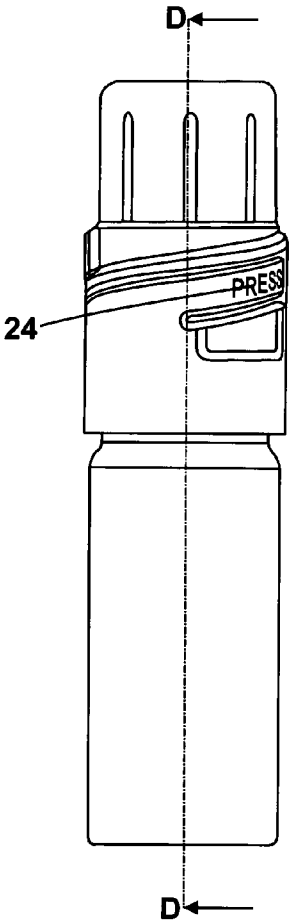
FIG. 6 is a side view of the container and closure of FIGS. 1 to 5.
Figure 5:
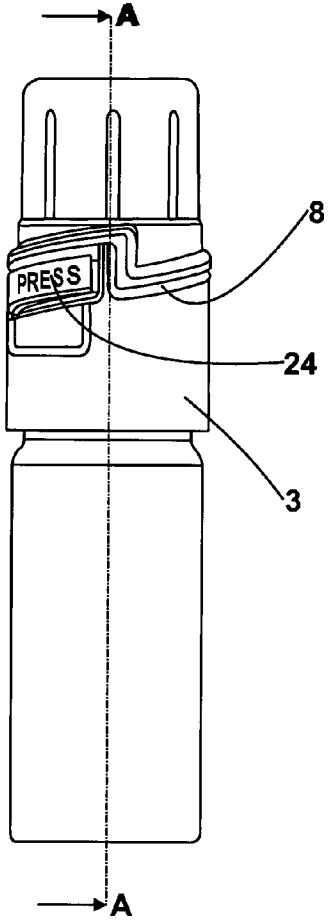
FIG. 5 is a cross-sectional view along the line A-A of FIG. 4.
Figure 4:
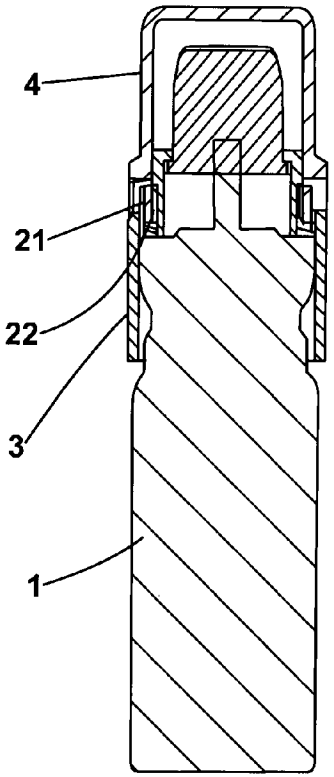
FIG. 4 is a side view of the container and closure of FIGS. 1 to 3.
Figure 10:
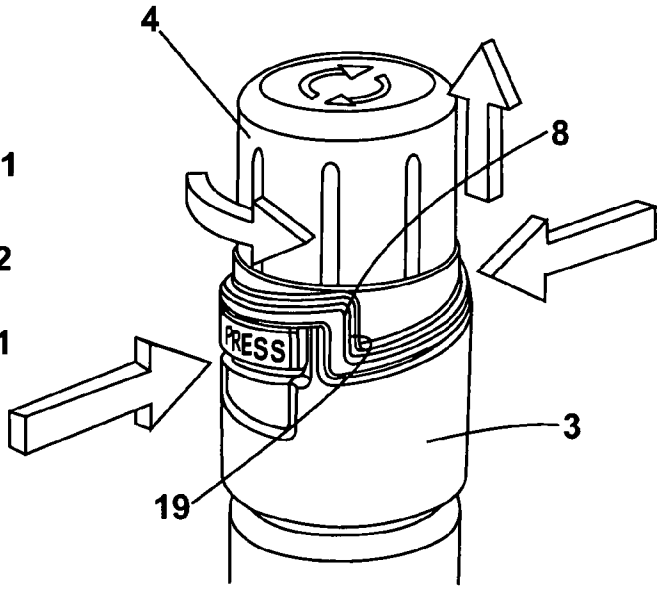
FIG. 10 is a perspective view of the closure of FIGS. 1 to 9 in the closed position with direction of movement indicated.
Figure 9:
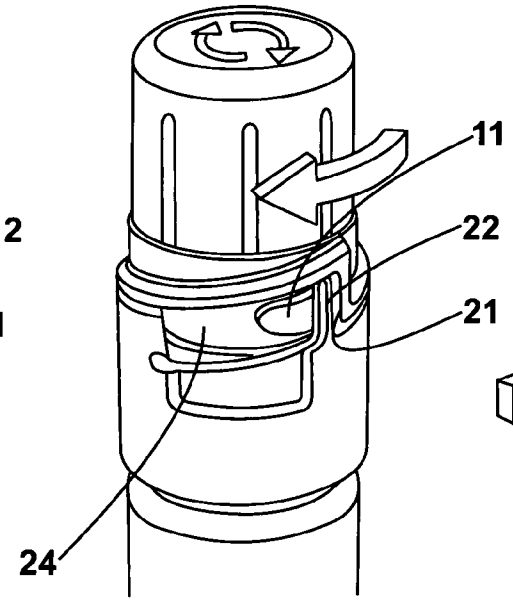
FIG. 9 is a perspective cut-away view of the closure of FIGS. 1 to 8 in the closed position showing the clip and clip stop.
Figure 8:
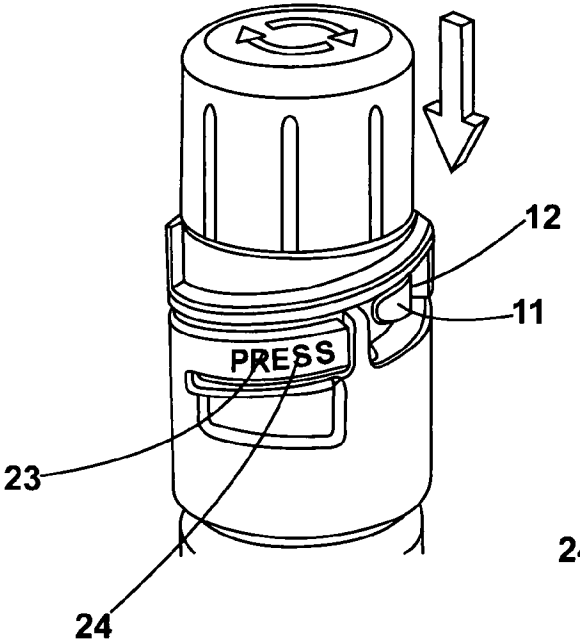
FIG. 8 is a perspective view of the closure of FIGS. 1 to 7 partially open.

Referring to the Figures, a child resistant container 1 comprises a vessel 2 provided with a collar 3 and a threadless cap 4.

The thread less cap 4 comprises a top portion 5 and a circumferential skirt 6. The rim 7 of the skirt 6 is inclined so as to create a circumferential sloping edge 8. The rim is also provided with a substantially perpendicular stop 9. The perpendicular stop 9 is provided with first engaging member comprising a clip 10 in the form of a resilient tongue 11 with a shoulder 12 on its trailing edge 13. The tongue 11 is substantially coplanar with the skirt 6, lying in a substantially circumferential plane. The tongue 11 comprises a resilient material and is biased radially away from the circumference of the skirt 6.

In the example illustrated, the vessel 2 is an aerosol container and comprises a closed end 14, a cylindrical body 15 and a delivery end 16. The body 15 has an outer surface 17. The collar 3 is positioned adjacent the delivery end 16 of the vessel 2.

The collar 3 comprises a circumferential band 18 with cut-away portion 19. The cut-away portion 19 is bordered by a circumferential sloping edge 20 and second engaging member comprising a substantially perpendicular clip stop edge 21. When in the closed position, the circumferential sloping edge 8 of the cap 4 and the cut-away portion 19 of the collar 3 form a snug fit.

The perpendicular clip stop edge 21 is provided with a slot 22 such that the clip 10 can be located in or through the slot 22. The collar 3 is substantially fixed to the surface 17 of the body 16 of the vessel 2. However, a region 23 of the collar 3 adjacent the slot 22 is raised away from the surface 17 of the body. The region 23 consists of a push tab 24. Thus, either the push tab 24 and/or the collar 3 should comprise a resiliently deformable material.

In use, to lock the thread less cap 4 to the vessel 2 and therefore seal the container 1, the thread less cap 4 is pressed onto the delivery end 16 of the vessel 2. With a clockwise rotational movement the clip 10 passes through the slot 22, the lip 13 and, in particular, the edge 14 of the clip 10 abuts the edge of the slot 22, locking the thread less cap 4 to the vessel 2. To open the cap 4, the push tab 24 is depressed. Depression of the push tab 24 causes the tongue 11 and shoulder 12 of the clip 10 to be pushed towards the body 16 and the surface 17 of the vessel 2. Thus, the shoulder 12 is disengaged from the collar slot 22 and the clip 10 is released, enabling the cap 4 to be removed by turning it in an anti-clockwise direction.

It will be appreciated that the collar 3 and cap 4 can both be rotated relative to the container 1, ie a user must grip the collar 3 or cap 4 to resist rotation thereof in order to be able to rotate the other of the collar 3 or cap 4 to release the cap 4 from the collar 3. It is therefore insufficient to hold only the container 1 and rotate the cap 4 as this simply rotates the collar 3 and cap 4 relative to the container 1.

This feature reduces the likelihood of children over stressing and snapping the cap 4 when trying to release the cap 4.

It will be appreciated by the person skilled in the art that references herein are illustrative only. In particular, it will be well understood that the references to clockwise and anti-clockwise movement should not be limited as the design may readily be altered to open with a clockwise movement and close with an anti-clockwise movement. In addition, although the concept of the invention is described in respect of an aerosol delivery device, the closure may also be adapted for other pack formats ie container and closure. Thus, for example, it is within the scope of the present invention for the closure of the invention to be adapted for other pack formats that the one specifically described herein. Thus, it is envisaged that the concept of the present invention could be used on a variety of packs, either with the collar as a separate component, or with the collar moulded as an integral part of the container.

The invention claimed is:

1. A child resistant closure for a container, said closure comprising a collar fixable to a container and a rotatable cap, wherein said cap is provided with a first engaging member, the collar is provided with a corresponding second engaging member, adjacent said second engaging member the collar is provided with a resiliently deformable integral push tab, and wherein the first and second engaging members are adapted to engage by rotation of the cap, wherein the first engaging member comprises a resilient clip, wherein the second engaging member comprises a clip stop, and wherein the clip comprises a tongue with a shoulder on a trailing edge of the tongue.

2. A child resistant closure according to claim 1 wherein the cap is thread less.

3. A child resistant closure according to claim 1 wherein the clip stop is located on the collar and the clip is located on the cap.

4. A child resistant closure according to claim 1 wherein the clip stop comprises a slot within a wall, wherein the clip comprises a tongue with a leading edge and a trailing edge, the leading edge of the tongue leading in the direction of rotation of the first and second engaging members toward a position of engagement and the trailing edge of the tongue lagging in the direction of rotation of the first and second engaging members toward a position of engagement, the trailing edge comprising a shoulder, and the slot and wall being dimensioned to allow the tongue to pass through the slot whilst the edge of the wall engages the shoulder of the clip.

5. A child resistant closure according to claim 1 wherein the upper surface of the collar is inclined.

6. A child resistant closure according to claim 1 wherein the collar is a substantially circumferential collar.

7. A child resistant closure according to claim 1 wherein the clip stop comprises a slot and wherein the slot and the clip are each circumferentially facing.

8. A child resistant closure according to claim 1 further comprising a pair of clips and corresponding clip stops are provided.

9. A child resistant closure according to claim 1 wherein the collar is fixable on the container so as to be rotatable in use relative to the container.

10. A container comprising a child resistant closure according to claim 1.

11. A container according to claim 10 wherein the container comprises an aerosol delivery device.

12. A child resistant closure for a container, said closure comprising a collar fixable to a container and a rotatable cap, wherein said cap is provided with a first engaging member, the collar is provided with a corresponding second engaging member, adjacent said second engaging member the collar is provided with a resiliently deformable integral push tab, and wherein the first and second engaging members are adapted to engage by rotation of the cap, wherein the first engaging member comprises a resilient clip, and wherein the second engaging member comprises a clip stop, wherein the upper surface of the collar is inclined, and wherein the lower surface of the cap is inclined corresponding to the incline of the collar.

13. A child resistant closure for a container, said closure comprising a collar fixable to a container and a rotatable cap, wherein said cap is provided with a first engaging member, the collar is provided with a corresponding second engaging member, adjacent said second engaging member the collar is provided with a resiliently deformable integral push tab, and wherein the first and second engaging members are adapted to engage by rotation of the cap, wherein the upper surface of the collar is inclined, and wherein the inclined surface of the collar is provided with a buffer.

14. A child resistant closure according to claim 13 wherein the buffer comprises a substantially vertical wall positioned on the inclined surface of the collar.

* * * * *